US012479550B1

(12) United States Patent
Blake

(10) Patent No.: US 12,479,550 B1
(45) Date of Patent: Nov. 25, 2025

(54) PADDLE POLE

(71) Applicant: Jerry Blake, Englewood, FL (US)

(72) Inventor: Jerry Blake, Englewood, FL (US)

( * ) Notice: Subject to any disclaimer, the term of this patent is extended or adjusted under 35 U.S.C. 154(b) by 0 days.

(21) Appl. No.: 19/032,636

(22) Filed: Jan. 21, 2025

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS

| | | | | | |
|---|---|---|---|---|---|
| 2,787,795 | A * | 4/1957 | Snodgrass | B63H 19/08 | 440/36 |
| 4,133,285 | A * | 1/1979 | Phillips | B63H 16/04 | 416/74 |
| 4,303,402 | A * | 12/1981 | Gooding | B63H 16/04 | 416/74 |
| 4,527,984 | A | 7/1985 | Gilbert | | |
| 6,168,480 | B1 | 1/2001 | Schaller | | |
| 6,220,197 | B1 * | 4/2001 | Pohlman | B63H 16/08 | 114/294 |
| 7,198,529 | B2 * | 4/2007 | Cleary | B63H 16/08 | 114/347 |
| 8,051,789 | B1 | 11/2011 | Tylisz | | |
| 8,540,537 | B1 | 9/2013 | Wong | | |
| 9,663,191 | B2 * | 5/2017 | Cromartie | B63B 21/243 | |
| 11,173,994 | B2 * | 11/2021 | Czubin | B63B 34/26 | |
| 2005/0153606 | A1 * | 7/2005 | Lane | B63H 16/04 | 440/101 |
| 2009/0170382 | A1 * | 7/2009 | Cromartie | B63H 16/00 | 114/221 R |
| 2010/0124859 | A1 * | 5/2010 | Bucknell | B63H 16/04 | 440/101 |
| 2011/0065341 | A1 | 3/2011 | Potter | | |
| 2013/0230398 | A1 * | 9/2013 | Hall | B63B 32/40 | 416/63 |
| 2013/0330190 | A1 * | 12/2013 | Kicker | B63H 16/04 | 29/889 |
| 2014/0050584 | A1 * | 2/2014 | Lange | A01K 87/00 | 43/22 |
| 2019/0291837 | A1 * | 9/2019 | Roger | F16B 5/0685 | |
| 2023/0211862 | A1 * | 7/2023 | Koh | B63H 16/06 | 440/106 |

* cited by examiner

*Primary Examiner* — S. Joseph Morano
*Assistant Examiner* — Jovon E Hayes
(74) *Attorney, Agent, or Firm* — Cramer Patent & Design, PLLC.; Aaron R. Cramer

(57) ABSTRACT

The present invention relates to a reconfigurable paddle pole for use with watercraft, addressing the need for a versatile tool that functions as an anchor pin, single-blade paddle, and double-blade paddle. The device includes a slide slot with structural components that allow for precise coupling and adjustment. An anchor shaft with a pointed tip provides sediment penetration for anchoring, while a paddle blade attachment featuring a first paddle enables conversion to a single-blade paddle. A T-handle and paddle section allow further conversion to a double-blade paddle. Locking mechanisms ensure secure operation. This invention provides an adaptable solution for stabilizing, maneuvering, and propelling watercraft, improving convenience and efficiency across multiple activities.

20 Claims, 3 Drawing Sheets

PADDLE POLE

RELATED APPLICATIONS

None.

FIELD OF THE DEVICE

The present device relates generally to the field of watercraft accessories and, more particularly, to a reconfigurable paddle pole device designed to function as an anchor pin, single-blade paddle, or double-blade paddle for stabilizing, maneuvering, and propelling watercraft in various aquatic environments.

BACKGROUND OF THE DEVICE

Watercraft users often encounter situations where multiple tools, such as anchor pins, single-blade paddles, and double-blade paddles, are required for effective operation. Existing solutions typically require separate devices for anchoring, paddling, or maneuvering, resulting in added bulk, inconvenience, and expense. Furthermore, traditional anchor pins often lack efficient mechanisms for deployment and removal, particularly in sediment-rich environments, while paddles may not offer adequate versatility or user comfort. There is a need for a single, multifunctional device that combines the functionalities of these tools in a compact, efficient, and user-friendly design. The present device addresses these challenges by providing a reconfigurable paddle pole that integrates anchoring and paddling capabilities, offering enhanced versatility, ease of use, and adaptability to various watercraft activities.

SUMMARY OF THE DEVICE

Embodiments of the present disclosure may include a reconfigurable paddle pole device for use with a watercraft. The device may include a slide slot, which comprises a first center tube, a second center tube, a left gap shaft, a right gap shaft, a top cross fitting, and a bottom cross fitting. In some embodiments, the first center tube and the second center tube may be aligned and separated by a center gap.

The device may further include an anchor shaft slidably coupled to the slide slot, the anchor shaft having a pointed tip configured for penetration into sediment at the bottom of a body of water. A locking collar may be detachably coupled to the anchor shaft within the slide slot to limit movement of the anchor shaft.

A T-handle may be detachably coupled to the first center tube, the T-handle comprising a T-handle shaft, a T-grip, a T-handle locking clip, and a T-handle foam grip. The device may also include a paddle blade attachment detachably coupled to the anchor shaft, the paddle blade attachment comprising a paddle blade, a slotted aperture, and a paddle blade locking clip. Additionally, a paddle section may be configured to replace the T-handle. The paddle section may include a paddle shaft, a second paddle blade, a paddle section locking clip, and a paddle section foam grip. In some embodiments, the paddle section and the paddle blade attachment may collectively form a double-blade paddle.

In some embodiments, the anchor shaft may be configured to be driven into and removed from sediment using a hammering action facilitated by the slide slot and the locking collar. The T-handle may serve as a handle for operating the anchor shaft when the device is configured as an anchor pin. The paddle blade attachment may include a drip guard positioned adjacent to the paddle blade locking clip to prevent water from running toward the user. Similarly, the paddle section may include a drip guard positioned at the junction between the second paddle blade and the paddle shaft to prevent water from running toward the user.

The first center tube and the second center tube may be configured to house the anchor shaft when the device is used as an anchor pin. The left gap shaft and the right gap shaft may define the maximum sliding distance of the anchor shaft within the slide slot. The device may also include measurement markings along the anchor shaft to assist in gauging water depth or sediment consistency. The locking collar may restrict vertical movement of the anchor shaft within the slide slot when in a locked position. The paddle blade attachment may be configured to be detachably secured to the anchor shaft using the slotted aperture and the paddle blade locking clip.

In some embodiments, the paddle section may be configured to couple to the first center tube using the paddle section locking clip. The slide slot may include right angle fittings to couple the left gap shaft and the right gap shaft to the top cross fitting and the bottom cross fitting. The slide slot, T-handle, paddle section, locking collar, and anchor shaft may be constructed from materials such as fiberglass, metal, composite materials, or combinations thereof. The paddle blade and the second paddle blade may be constructed from plastic.

In some embodiments, the invention includes a version that consists of all the described elements to maximize its functionality and adaptability in various watercraft activities. Specifically, the device includes a detachable extension shaft that is coupled to either the T-handle or the paddle section to increase the overall length of the device, providing enhanced usability in deeper water or with larger watercraft. The extension shaft is constructed from lightweight and durable materials, such as aluminum or carbon fiber, and attaches using a locking mechanism similar to the locking collar. Additionally, this version incorporates integrated measurement markings along the anchor shaft to assist users in determining water depth or sediment consistency. These markings begin at the pointed tip of the anchor shaft and extend toward the locking collar, allowing precise gauging during operation. This embodiment provides a fully comprehensive solution for stabilizing, maneuvering, and propelling watercraft with enhanced versatility and user convenience.

A method of using the reconfigurable paddle pole device may include configuring the device as an anchor pin by attaching the T-handle to the first center tube, sliding the anchor shaft through the slide slot, and locking the anchor shaft in place with the locking collar. The method may further include driving the anchor shaft into sediment at the bottom of a body of water using a hammering action facilitated by the slide slot and the locking collar.

The method may also include converting the device into a single-blade paddle by attaching the paddle blade attachment to the anchor shaft. To convert the device into a double-blade paddle, the T-handle may be replaced with the paddle section, and the paddle blade attachment may be coupled to the opposite end of the anchor shaft. The method may include removing the anchor shaft from sediment using a reverse hammering action facilitated by the slide slot and the locking collar. The anchor shaft may also be used as a push pole by pushing it against the bottom of the body of water at an oblique angle. It should be noted that the device is still operable as an anchor and push pole with one or both of the paddle blades attached.

Additional steps may include adjusting the overall length of the device by repositioning the T-handle and the anchor shaft, preventing water from dripping toward the user during paddle use by utilizing the drip guards on the paddle blade attachment and the paddle section, and using the measurement markings on the anchor shaft to determine water depth or sediment consistency.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
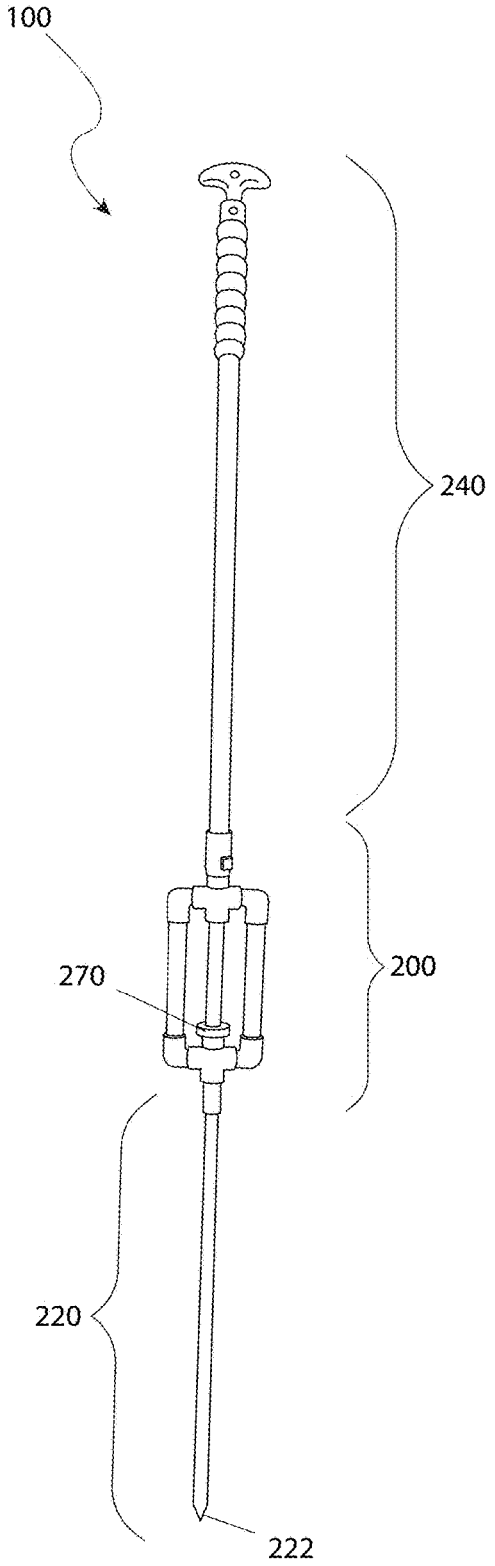
FIG. 1 is a front view of a paddle pole 100, according to an embodiment of the present invention.
Figure 2:
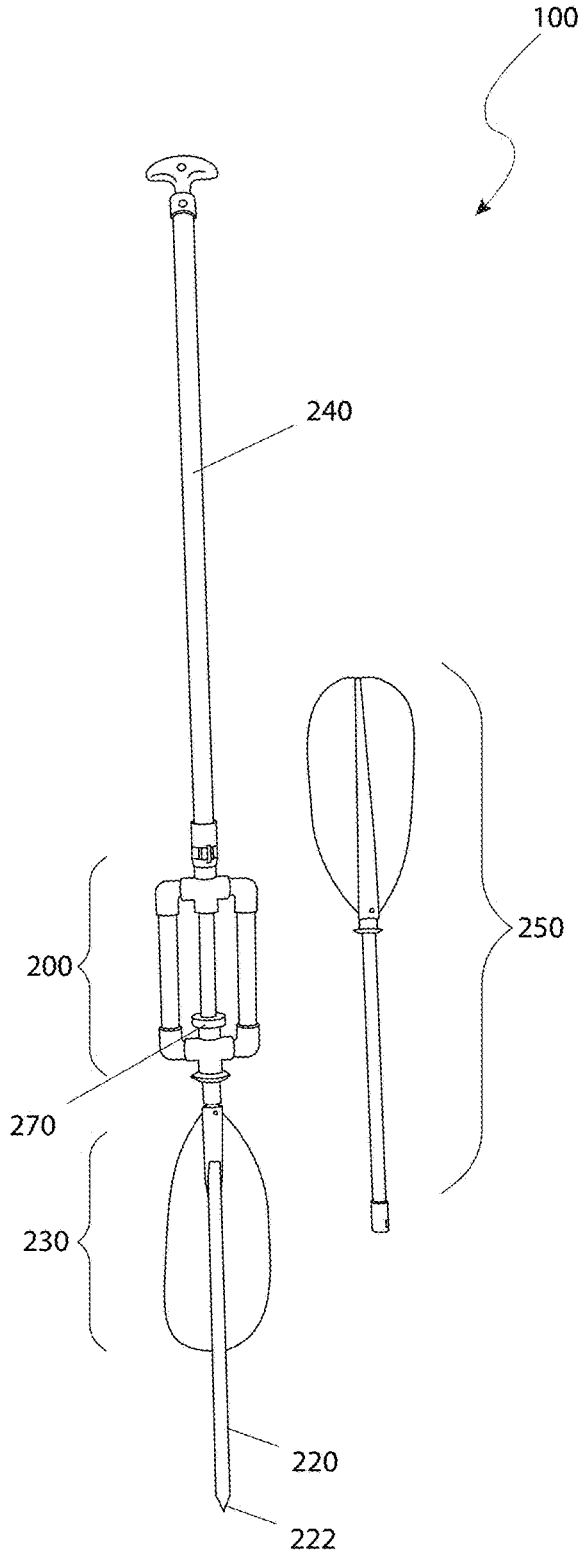
FIG. 2 is a front view of a paddle pole 100, according to an embodiment of the present invention, illustrating the paddle blade attachment 230 coupled to the anchor shaft 220 and illustrating the paddle section 250 ready to replace the T-handle 240.
Figure 3:
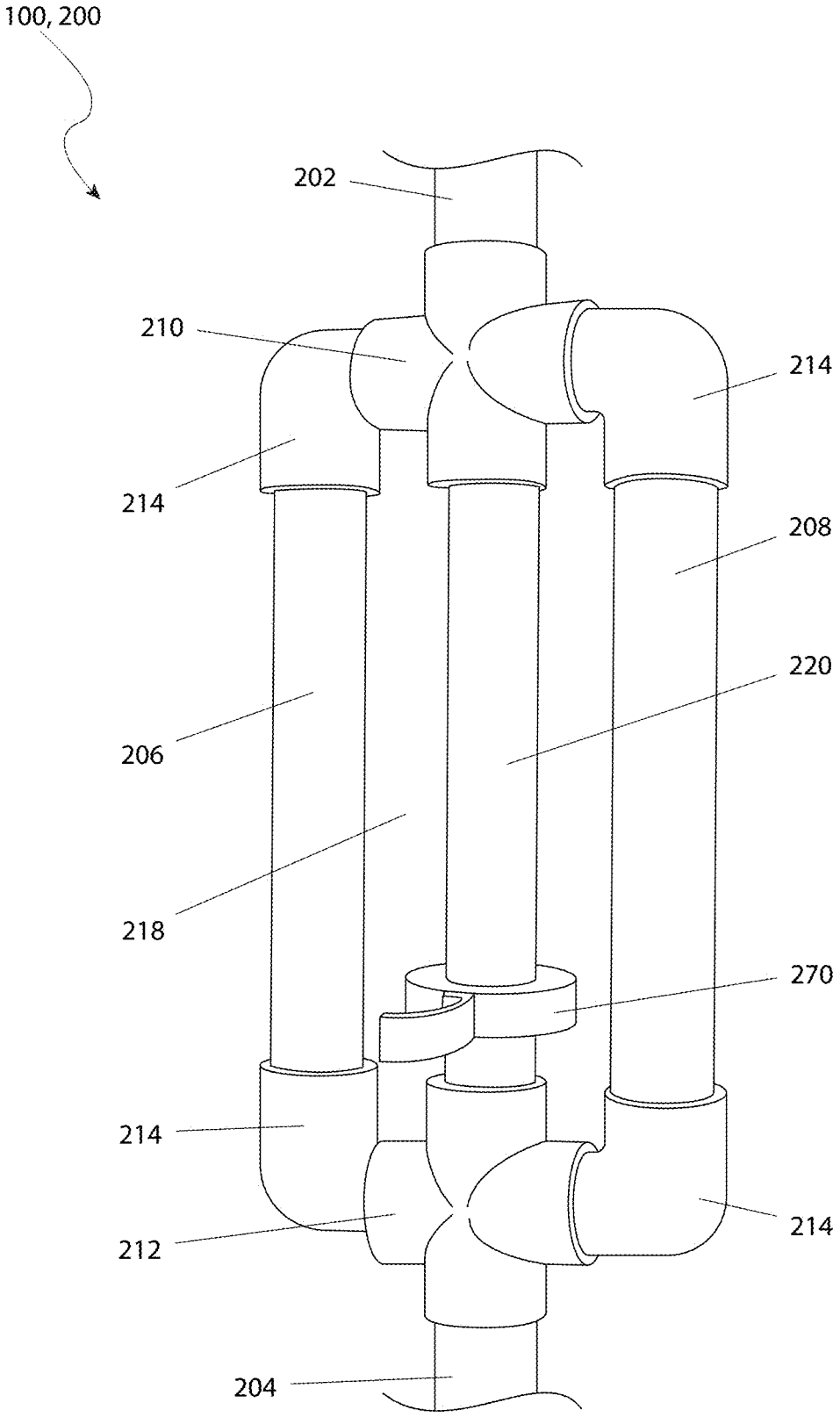
FIG. 3 is a detail view of a paddle pole 100, according to an embodiment of the present invention, illustrating the slide slot 200; and, FIG. 4 is an exploded view of a paddle pole 100, according to an embodiment of the present invention.
Figure 4:
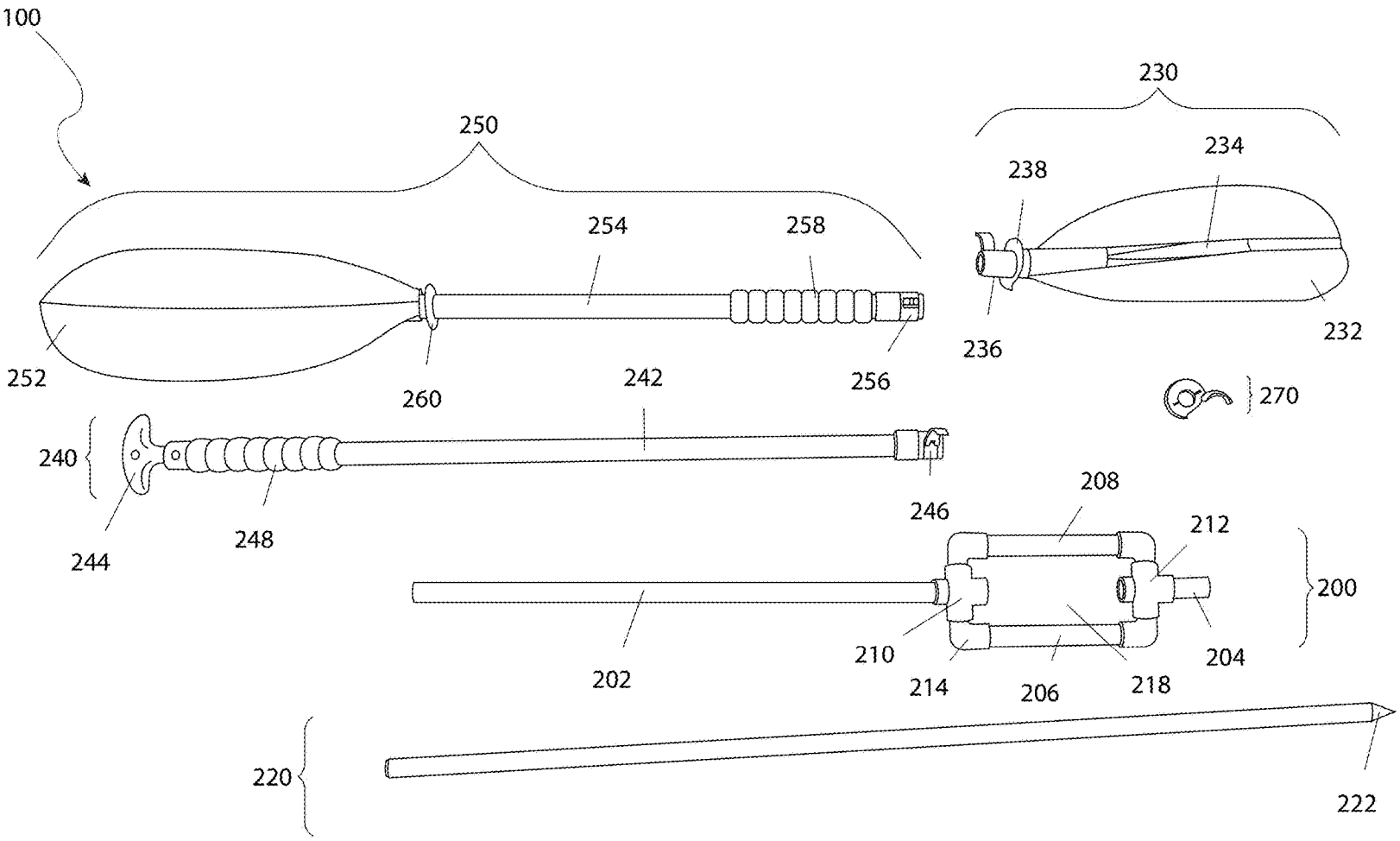

100 paddle pole
200 slide slot
202 first center tube
204 second center tube
206 left gap shaft
208 right gap shaft
210 top cross fitting
212 bottom cross fitting
214 right angle fitting
218 center gap
220 anchor shaft
222 pointed tip
230 paddle blade attachment
232 first paddle
234 slotted aperture
236 paddle blade locking clip
238 first paddle drip guard
240 T-handle
242 T-handle shaft
244 T-grip
246 T-handle locking clip
248 T-handle foam grip
250 paddle section
252 second paddle
254 paddle section shaft
256 paddle section locking clip
258 paddle section foam grip
260 second paddle drip guard
270 locking collar

1. Description of the Invention

The present invention is directed to a paddle pole (herein described as the "invention") 100. The invention 100 may comprise a slide slot 200, an anchor shaft 220, a T-handle 240, a paddle blade attachment 230, a paddle section 250, and a locking collar 270. The invention 100 may be a reconfigurable accessory for use with a watercraft. The slide slot 200, the anchor shaft 220, the T-handle 240, and the locking collar 270 may be combined to form an anchor pin that may hold the watercraft stationary. A hammering action applied to the slide slot 200 may be operable to push the anchor shaft 220 into and out of sediment at the bottom of a body of water. The paddle blade attachment 230 may be added to the anchor shaft 220 to form a single-blade paddle for moving the watercraft. The T-handle 240 may be replaced by the paddle section 250 to form a double-blade paddle.

The slide slot 200 may be a sliding coupler at the center of the invention 100. The anchor shaft 220 may slidably couple to the slide slot 200. The locking collar 270 may detachably couple to the anchor shaft 220 within the slide slot 200 to retain the anchor shaft 220 on the slide slot 200.

The slide slot 200 may comprise a first center tube 202, a second center tube 204, a left gap shaft 206, a right gap shaft 208, a top cross fitting 210, a bottom cross fitting 212, and a plurality of right angle fittings 214. The first center tube 202 and the second center tube 204 may be hollow cylindrical tubes. The first center tube 202 may be located at the top of the slide slot 200 and the second center tube 204 may be located at the bottom of the slide slot 200. The first center tube 202 may be aligned with the second center tube 204. The bottom of the first center tube 202 may be coupled to the top of the top cross fitting 210 and the top of the second center tube 204 may be coupled to the bottom of the bottom cross fitting 212. The left gap shaft 206 and the right gap shaft 208 may be parallel to each other and aligned to be parallel to the axis of the first center tube 202 and the second center tube 204. The length of the left gap shaft 206 may be the same as the length of the right gap shaft 208. The length of the left gap shaft 206 and the right gap shaft 208 may determine the maximum sliding distance for the anchor shaft 220 when the anchor shaft 220 is restrained by the locking collar 270. The first center tube 202 and the second center tube 204 may be separated to define a center gap 218. The left gap shaft 206 and the right gap shaft 208 may be coupled to the top cross fitting 210 and to the bottom cross fitting 212 by the plurality of right angle fittings 214.

The diameters of the first center tube 202, the second center tube 204, the top of the top cross fitting 210, the bottom of the top cross fitting 210, the top of the bottom cross fitting 212, and the bottom of the bottom cross fitting 212 may be larger than the diameter of the anchor shaft 220 such that the anchor shaft 220 may slide through the slide slot 200 when unrestrained by the locking collar 270. The anchor shaft 220 may pass through the center gap 218 as the anchor shaft 220 slides through the slide slot 200.

The anchor shaft 220 may be a cylindrical armature comprising a pointed tip 222. The pointed tip 222 may be oriented downwards during use. The anchor shaft 220 may be hammered down to drive the pointed tip 222 into the sediment at the bottom of the body of water in order to hold the watercraft stationary. The top of the anchor shaft 220 may pass up through the bottom cross fitting 212, through the locking collar 270 in the center gap 218, and through the top cross fitting 210.

The T-handle 240 may detachably couple to the top of the slide slot 200. The T-handle 240 may be adapted to be grasped by a user in order to operate the invention 100.

The T-handle 240 may comprise a T-handle shaft 242 and a T-grip 244. The T-handle shaft 242 may be a rigid cylindrical armature used in a vertical orientation. The T-grip 244 may couple to the top end of the T-handle shaft 242 to form a T-shape.

The bottom of the T-handle 240 may comprise a T-handle locking clip 246. The T-handle locking clip 246 may be locked to retain the T-handle 240 on the first center tube 202. The T-handle shaft 242 may comprise a T-handle foam grip 248 that may be operable to enhance comfort and control of the T-handle 240.

The overall length of the invention 100 may be adjustable by repositioning the T-handle 240 after unlocking the T-handle locking clip 246 and by repositioning the anchor shaft 220 after unlocking the locking collar 270.

The paddle blade attachment 230 may detachably couple to the anchor shaft 220 to convert the invention 100 into the single-blade paddle. The paddle blade attachment 230 may comprise a first paddle 232. The first paddle 232 may comprise a slotted aperture 234 and a paddle blade locking clip 236. The pointed tip 222 of the anchor shaft 220 may slide through the paddle blade locking clip 236 and through the slotted aperture 234. The paddle blade locking clip 236 may be locked to retain the first paddle 232 on the anchor shaft 220. The first paddle 232 may comprise a first paddle drip guard 238 located adjacent to the paddle blade locking clip 236. The first paddle drip guard 238 may be adapted to prevent water from running from the first paddle 232 towards the user.

The paddle section 250 may replace the T-handle 240 in order to form, in conjunction with the paddle blade attachment 230, the double-blade paddle. The paddle section 250 may detachably couple to the first center tube 202 and the paddle blade attachment 230 may detachably couple to the anchor shaft 220 on the opposite end of the invention 100 such that two (2) blades may be positioned on opposites sides of the watercraft and used to move the watercraft.

The paddle section 250 may comprise a second paddle 252 and a paddle section shaft 254. The second paddle 252 may be coupled to the upper end of the paddle section shaft 254. The bottom end of the paddle section shaft 254 may couple to the first center tube 202. The paddle section shaft 254 may be retained on the first center tube 202 by a paddle section locking clip 256.

The paddle section shaft 254 may comprise a paddle section foam grip 258 that may be operable to enhance comfort and control of the paddle section shaft 254.

The second paddle 252 may comprise a second paddle drip guard 260 located at the junction of the second paddle 252 and the paddle section shaft 254. The second paddle drip guard 260 may be adapted to prevent water from running from the second paddle 252 towards the user.

The locking collar 270 may encircle the anchor shaft 220. The locking collar 270 may be locked to retain the locking collar 270 to the anchor shaft 220 and may be unlocked to detach the locking collar 270 from the anchor shaft 220. The locking collar 270 may limit the travel distance of the anchor shaft 220 within the slide slot 200 when the locking collar 270 is locked to the anchor shaft 220.

As non-limiting examples, the slide slot 200, the T-handle 240, the paddle section shaft 254, the locking collar 270, and the anchor shaft 220 may be made of fiberglass, metal, composite materials, or any combination thereof. As non-limiting examples, the first paddle 232 and the second paddle 252 may be made of plastic.

In use, the slide slot 200, the anchor shaft 220, the locking collar 270, and the T-handle 240 may be configured for use as an anchor pin. The anchor shaft 220 and the locking collar 270 may be coupled to the slide slot 200 via the second center tube 204. The T-handle 240 be coupled to the slide slot 200 via the first center tube 202. The anchor pin may be pushed straight down into sediment at the bottom of a body of water in order to anchor the watercraft. The pointed tip 222 of the anchor shaft 220 may be hammered into the sediment using a "pile driver" action that involves lifting the slide slot 200 and striking downwards such that the top of the slide slot 200 strikes the top of the locking collar 270. Because the locking collar 270 is locked to the anchor shaft 220, this hammering motion may drive the anchor shaft 220 downwards. If the anchor shaft 220 proves difficult to remove from the sediment, a "reverse pile driver" action may free the anchor shaft 220. The "reverse pile driver" action may involve lowering the slide slot 200 and striking upwards such that the bottom of the slide slot 200 strikes the bottom of the locking collar 270.

The anchor pin may be used as a push pole by pushing against the bottom of the body of water at an oblique angle. If the push pole pushes into the sediment and is therefore difficult to remove, the same "reverse pile driver" action described above can be used to remove the anchor shaft 220 from the sediment without losing momentum gain by pushing with the push pole.

The paddle blade attachment 230 may be detachably coupled to the anchor shaft 220 to convert the invention 100 into a single-blade paddle.

The paddle section 250 may replace the T-handle 240 to convert the single-blade paddle into a double-blade paddle.

In another embodiment, the invention 100 consists of all the device elements to enhance its functionality and usability in various watercraft activities. Specifically, the invention 100 incorporates a detachable extension shaft (not shown) that can be connected to either the T-handle 240 or the paddle section 250 to increase the overall length of the device. This feature provides greater versatility, allowing users to utilize the invention 100 in deeper water or with larger watercraft. The extension shaft will be made from lightweight and durable materials, such as aluminum or carbon fiber, and can be attached using a locking mechanism similar to the locking collar 270. Furthermore, the invention 100 includes integrated measurement markings along the anchor shaft 220 to assist users in gauging water depth or sediment consistency when deploying the anchor pin. These markings will be aligned along the length of the anchor shaft 220, starting from the pointed tip 222 and extending toward the locking collar 270.

The slide slot 200, which includes the first center tube 202, the second center tube 204, the left gap shaft 206, and the right gap shaft 208, provides the structural framework for coupling various components. The top cross fitting 210 and bottom cross fitting 212, connected via the right angle fittings 214, enable secure alignment and maintain the center gap 218 through which the anchor shaft 220 slides. The paddle blade attachment 230, which features the first paddle 232, a slotted aperture 234, and a paddle blade locking clip 236, can be affixed to the anchor shaft 220 to create a single-blade paddle. The first paddle drip guard 238 is positioned to prevent water from dripping toward the user.

The T-handle 240, comprising the T-handle shaft 242, T-grip 244, T-handle locking clip 246, and T-handle foam grip 248, can be replaced by the paddle section 250 for creating a double-blade paddle. The paddle section 250 includes the second paddle 252, paddle section shaft 254, paddle section locking clip 256, and paddle section foam grip 258, as well as a second paddle drip guard 260 to prevent water from dripping toward the user. These enhancements, along with the structural integrity provided by the slide slot 200 and its components, ensure that the invention 100 can adapt to a variety of operational needs while maintaining ease of use and reliability.

The foregoing descriptions of specific embodiments of the present invention, including a version comprising all elements described herein, have been presented for purposes of illustration and description. This comprehensive embodiment integrates the paddle pole 100, the slide slot 200, the anchor shaft 220 with its pointed tip 222, the paddle blade attachment 230 with the first paddle 232, the slotted aperture 234, the paddle blade locking clip 236, and the first paddle drip guard 238. It further includes the T-handle 240 with its T-handle shaft 242, T-grip 244, T-handle locking clip 246, and T-handle foam grip 248, as well as the paddle section 250, comprising the second paddle 252, paddle section shaft 254, paddle section locking clip 256, paddle section foam grip 258, and second paddle drip guard 260. Supporting structures such as the first center tube 202, second center tube 204, left gap shaft 206, right gap shaft 208, top cross fitting 210, bottom cross fitting 212, right angle fittings 214, center gap 218, and locking collar 270 are also integral to the embodiment's functionality. While these specific features have been disclosed to provide a clear understanding of the invention's design and application, they are not intended to be exhaustive or limit the invention to the precise forms described. Modifications and variations, including material substitutions, alternative coupling mechanisms, or additional enhancements, are possible within the scope of the invention. These embodiments were chosen and described to best explain the principles of the invention and its practical application, enabling those skilled in the art to utilize the invention and its various embodiments effectively, with modifications as suited to the intended use.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A reconfigurable paddle pole device for use with a watercraft, comprising:

a slide slot including a first center tube, a second center tube, a left gap shaft, a right gap shaft, a top cross fitting, and a bottom cross fitting, wherein the first center tube and the second center tube are aligned and separated by a center gap;

an anchor shaft slidably coupled to the slide slot, the anchor shaft having a pointed tip configured for penetration into sediment at the bottom of a body of water;

a locking collar detachably coupled to the anchor shaft within the slide slot to limit movement of the anchor shaft;

a T-handle detachably coupled to the first center tube, the T-handle comprising a T handle shaft, a T-grip, a T-handle locking clip, and a T-handle foam grip;

a paddle blade attachment detachably coupled to the anchor shaft, the paddle blade attachment comprising a paddle blade, a slotted aperture, and a paddle blade locking clip; and, a paddle section configured to replace the T-handle, the paddle section comprising a paddle shaft, a second paddle blade, a paddle section locking clip, and a paddle section foam grip, wherein the paddle section and the paddle blade attachment collectively form a double-blade paddle.

2. The device of claim 1, wherein the anchor shaft is configured to be driven into and removed from sediment using a hammering action facilitated by the slide slot and the locking collar.

3. The device of claim 1, wherein the T-handle is configured for use as a handle to operate the anchor shaft when the device is configured as an anchor pin.

4. The device of claim 1, wherein the paddle blade attachment includes a drip guard positioned adjacent to the paddle blade locking clip to prevent water from running toward a user.

5. The device of claim 1, wherein the paddle section includes a drip guard positioned at a junction between the second paddle blade and the paddle shaft to prevent water from running toward a user.

6. The device of claim 1, wherein the first center tube and the second center tube are configured to house the anchor shaft when the device is used as an anchor pin.

7. The device of claim 1, wherein the left gap shaft and the right gap shaft define a maximum sliding distance of the anchor shaft within the slide slot.

8. The device of claim 1, further comprising measurement markings along the anchor shaft for gauging water depth or sediment consistency.

9. The device of claim 1, wherein the locking collar is configured to restrict vertical movement of the anchor shaft within the slide slot when the locking collar is in a locked position.

10. The device of claim 1, wherein the paddle blade attachment is configured to be detachably secured to the anchor shaft using the slotted aperture and the paddle blade locking clip.

11. The device of claim 1, wherein the paddle section is configured to couple to the first center tube using the paddle section locking clip.

12. The device of claim 1, wherein the slide slot includes right angle fittings configured to couple the left gap shaft and the right gap shaft to the top cross fitting and the bottom cross fitting.

13. The device of claim 1, wherein the slide slot, the T-handle, the paddle section, the locking collar, and the anchor shaft are constructed from materials selected from the group consisting of fiberglass, metal, composite materials, and combinations thereof.

14. The device of claim 1, wherein the paddle blade and the second paddle blade are constructed from plastic.

15. A method of using the reconfigurable paddle pole device of claim 1, comprising:

configuring the device as an anchor pin by attaching the T-handle to the first center tube, sliding the anchor shaft through the slide slot, and locking the anchor shaft in place with the locking collar;

driving the anchor shaft into sediment at the bottom of a body of water using a hammering action facilitated by the slide slot and the locking collar;

converting the device into a single-blade paddle by detaching the T-handle and attaching the paddle blade attachment to the anchor shaft; and converting the device into a double-blade paddle by replacing the T-handle with the paddle section and coupling the paddle blade attachment to an opposite end of the anchor shaft.

16. The method of claim 15, further comprising removing the anchor shaft from sediment using a reverse hammering action facilitated by the slide slot and the locking collar.

17. The method of claim 15, further comprising using the anchor shaft as a push pole by pushing the anchor shaft against a bottom of the body of water at an oblique angle.

18. The method of claim 15, further comprising adjusting an overall length of the device by repositioning the T-handle and the anchor shaft.

19. The method of claim 15, further comprising preventing water from dripping toward a user during paddle use by utilizing the drip guards on the paddle blade attachment and the paddle section.

20. The method of claim 15, further comprising using the measurement markings on the anchor shaft to determine water depth or sediment consistency.

* * * * *